US005208064A

United States Patent [19]

Becker et al.

[11] Patent Number: 5,208,064

[45] Date of Patent: May 4, 1993

[54] METHOD AND APPARATUS FOR OPTICALLY MONITORING AND CONTROLLING A MOVING FIBER OF MATERIAL

[75] Inventors: Kevin C. Becker, Westlake; Patrick J. O'Keefe, Jr., Wellington; Eddie W. Dixson, Jr., Cleveland, all of Ohio

[73] Assignee: Nordson Corporation, Westlake, Ohio

[21] Appl. No.: 787,237

[22] Filed: Nov. 4, 1991

[51] Int. Cl.[5] ..... B05D 1/00

[52] U.S. Cl. ..... 427/8; 118/712; 250/561; 250/571; 356/429

[58] Field of Search ..... 427/8, 10; 118/688, 118/712; 356/429; 250/561, 571, 222.1

[56] References Cited

U.S. PATENT DOCUMENTS

| | | | |
|---|---|---|---|
| 3,316,410 | 4/1967 | Meili et al. | 250/218 |
| 3,587,079 | 6/1971 | Obergefell et al. | 340/270 |
| 4,102,177 | 7/1978 | Okada et al. | 73/32 |
| 4,260,258 | 4/1981 | Rose et al. | 356/335 |
| 4,498,012 | 2/1985 | Finch | 604/65 |
| 4,629,903 | 12/1986 | Giacobbe et al. | 250/573 |
| 4,680,462 | 7/1987 | Kamen | 250/222.1 |
| 4,706,267 | 11/1987 | Chase et al. | 378/61 |
| 4,785,996 | 11/1988 | Ziecker et al. | 239/298 |
| 4,820,281 | 4/1989 | Lawler, Jr. | 604/253 |
| 4,857,749 | 8/1989 | McCarty | 250/571 |
| 4,905,897 | 3/1990 | Rogers et al. | 239/1 |
| 4,935,261 | 6/1990 | Srivastava et al. | 427/10 |
| 4,963,757 | 10/1990 | Liefde et al. | 250/571 |
| 5,002,537 | 3/1991 | Coble et al. | 604/253 |
| 5,012,496 | 4/1991 | Weinreb et al. | 377/21 |
| 5,045,069 | 9/1991 | Imparato | 604/253 |
| 5,060,250 | 10/1991 | Kwee et al. | 378/61 |

FOREIGN PATENT DOCUMENTS

| | | |
|---|---|---|
| 0239689 | 10/1987 | European Pat. Off. . |
| 3817096 | 12/1988 | Fed. Rep. of Germany . |
| 6352024 | 9/1989 | Japan . |
| 8911917 | 12/1989 | PCT Int'l Appl. . |

*Primary Examiner*—Shrive Beck
*Assistant Examiner*—Katherine A. Bareford
*Attorney, Agent, or Firm*—Raymond J. Slattery, III

[57] ABSTRACT

A beam of light is transmitted from a transmitter (30) which is broken as the moving fiber (22) passes through the beam. A receiver (32) receives the light and generates a signal in response thereto. The signal is processed to determine the status of the pattern generated by the moving fiber (22) of material. In response to changes in the status of the pattern, the rate at which the fiber is dispensed and/or the movement of the pattern can be adjusted as well as alarm conditions noted.

20 Claims, 5 Drawing Sheets

METHOD AND APPARATUS FOR OPTICALLY MONITORING AND CONTROLLING A MOVING FIBER OF MATERIAL

BACKGROUND OF THE INVENTION

The present invention relates generally to the monitoring and/or controlling of a fiber of material such as a stream, bead, filament, strand, chord, thread, etc. More particularly the invention relates to the monitoring and/or controlling of the above materials where the material is moving or traveling in space in a moving path or pattern such as, for example, a rotating swirl pattern. The material may be either a solid or liquid such as, for example, metallic wire, fiberglass, filaments, adhesives, sealants, caulks, etc.

While not to be limited to, the present invention is especially useful for use in a controlled fiberization system. Controlled fiberization is a process for the application onto substrates of coating materials.

With controlled fiberization, a high viscosity material such as adhesive is dispensed in a continuous flowable stream or fiber, usually in the form of a swirling spiral pattern extending from a dispensing nozzle onto a substrate. The swirling movement of the pattern may be formed by ejecting the high viscosity material under pressure to form a continuous adhesive fiber which is then propelled to swirl into a rotating pattern, which moves toward the substrate, by streams of air. It is believed that the air streams, together with the forward momentum and centrifugal force of the ejected material, force the material into a rotating outwardly spiraling helical pattern in which its own cohesive and elastic properties hold it in a string-like or rope-like strand.

Controlled fiberization methods for the application of pressure sensitive adhesives and the devices using such methods are described, for example, in U.S. Pat. No. 4,785,996 entitled ADHESIVE SPRAY GUN AND NOZZLE ATTACHMENT assigned to Nordson Corporation, Amherst, Ohio, the assignee of the present invention, and hereby expressly incorporated herein by reference.

Accordingly, there is a need to provide coating material dispensing systems and processes, with monitoring capabilities that can accurately, quickly and economically determine the performance of the system components and of the adhesive application process.

SUMMARY OF THE INVENTION

An objective of the present invention is to provide a method and apparatus for controlling and monitoring the movement of a fiber of material in a moving pattern such as occurs in the dispensing of: coating materials in a controlled fiberization dispensing system, the dispensing of fiber glass, the manufacture of cables, wire or other operations in which a filament, strand, stream, etc. is rotated or moved in a predetermined manner or pattern.

From the extracted information, the effects of changes in parameters such as pressures and temperatures can be detected, and failures of the system, such as a clogged air jet or nozzle, can be immediately determined. In one application of the invention, signals are analyzed for the purpose of determining the performance of the dispensing device components so defects in the manufacture of system components can be quickly identified. In another application of the invention, signals are analyzed for the purpose of detecting deviations from optimal system operation, and adjustments are made, either by manual servicing of the equipment or through closed loop feedback control. In a further application of the invention, closed loop control of system parameters, such as adhesive nozzle or air jet pressure, for example, maintains a desired coating distribution on the substrate as other parameters such as line speed change.

In a preferred embodiment of the invention, signals received from sensors near the moving pattern are analyzed to extract information, such as the frequency or period and the symmetry of the swirl, from which characteristics of the pattern being deposited on the substrate can be determined. For example, relative changes in the radius of the pattern being deposited as well as the relative pattern placement can be determined. In the case of the dispensing of a liquid, the relative quantity of material dispensed from a dispenser can also be determined. The monitoring characteristics of the pattern can be correlated with predetermined criteria, such as signals from similar measurements taken under desired conditions for reference and comparison. Deviations detected in monitored data are used during the operation to detect changes in the characteristics for determination of the causes of the changes. This can include error diagnostics where it can be determined if a fiber is present or if, in fact, the fiber is swirling.

These and other objects, features, and advantages can be accomplished by a method of monitoring a fiber of material comprising: transmitting a beam of light; causing the fiber to repeatedly pass through the beam of light; generating a signal in response to the presence or absence of the fiber within the beam of light; determining an interval between the presence of the fiber in the beam of light and a subsequent presence of the fiber in the beam of light; and comparing the interval to a reference.

These and other objects, features, and advantages can be also accomplished by a method of monitoring or controlling a fiber moving generally from a discharge opening to a substrate in a repeating pattern, comprising the steps of: a) determining a period of the pattern; b) determining the symmetry of the pattern; c) comparing the period and the symmetry of the pattern to a respective reference; d) in response to said comparison, performing at least one of the following steps: (i) changing the rate at which the fiber is dispensed from the discharged opening, (ii) varying the period of the pattern, (iii) indicating the status of the pattern, and (iv) repeating steps (a) through (d).

These and other objects, features, and advantages can be further accomplished by a system of monitoring a fiber of material comprising: a transmitting means for transmitting a beam of light; a receiving means, aligned with the beam of light for generating a first signal in response thereto; a means, responsive to the first signal, for generating a second signal indicative of, or proportioned to, a time interval between a breaking of the beam of light by the fiber and a subsequent breaking of the beam of light by the fiber; and a means for comparing the time interval to a reference.

These and other objects, features, and advantages can be still further accomplished by a dispensing system comprising: a dispensing means having a discharge opening for dispensing a fiber of material and a means for causing the dispensed fiber of material to propagate in a moving pattern through a space between the discharge opening and a substrate; a transmitting means for transmitting a beam of light; a receiving means, aligned with the beam of light for generating a signal in response thereto, and the transmitting and receiving means positioned such that under normal operating conditions, the fiber of material will pass through the beam of light at least twice as it propagates in the moving pattern; a means, responsive to the signal generated by the receiving means for generating an edge signal when an edge of the fiber bears a predetermined relationship to the beam of light; a means for generating a symmetry signal indicative of, or proportional to, either a time interval between a first said edge signal and a second edge signal or a time interval between the second said edge signal and a third edge signal; a means, generating a period signal indicative of, or proportional to, the time interval between said first edge signal and said third edge signal; and a means, responsive to said period and symmetry signals for determining the status of the motion of the pattern.

BRIEF DESCRIPTION OF THE DRAWINGS

The following is a brief description of the drawings in which like parts may bear like reference numerals and in which.

DETAILED DESCRIPTION OF THE INVENTION

Figure 1:
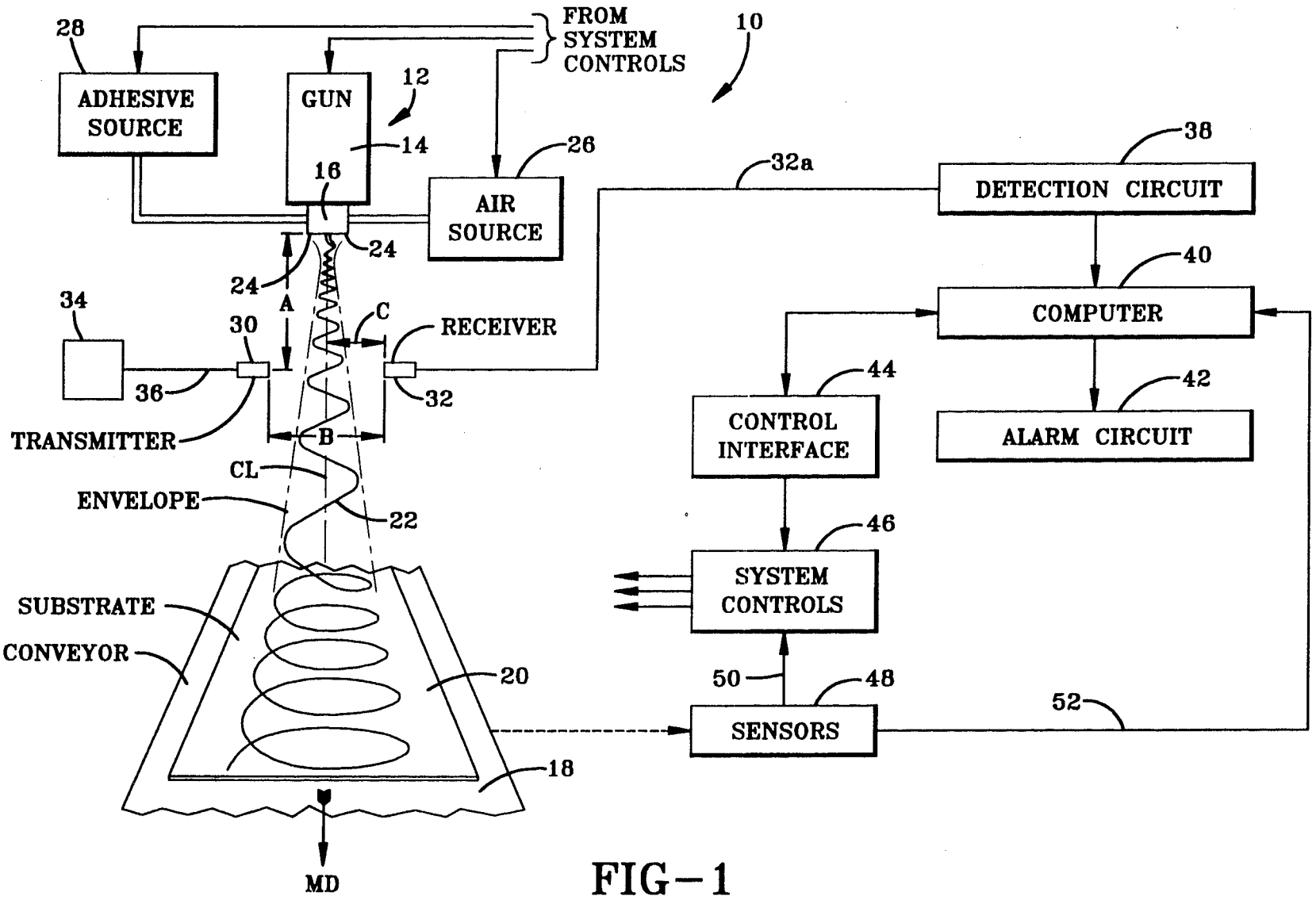
FIG. 1—Is a diagrammatic elevation view according to one embodiment of the invention, illustrating an adhesive dispensing system.

With reference to FIG. 1, a portion of an adhesive dispensing system is shown generally as Reference No. 10. The adhesive dispensing system 10 includes a dispenser 12 which includes a gun 14 and a nozzle 16. The dispenser 12 may be, for example, a Nordson® Model H200-J or Model CF-200 Controlled Fiberization Gun and Nozzle manufactured and sold by Nordson Corporation, Amherst, Ohio. The dispenser 12, for example, may be positioned above a moving conveyer 18 which transports a substrate 20 that is the object onto which adhesive is to be deposited.

In a Controlled Fiberization (sometimes referred to as swirl spray) System, adhesive in the form of a continuous stream or fiber 22 is ejected from the nozzle 16 and propelled by air from an array of air jets 24. A source of pressurized air 26, such as shop air, supplies the air to the dispenser 12. The adhesive, which may be a hot melt adhesive, may be supplied to the dispenser 12 from an adhesive source 28 by, for example, a gear pump driven hot melt applicator.

The streams of air emitted from the air jets 24 causes the fiber 22 to begin to swirl and assume a continuous spiral or helix shape which may be conical, having its apex in the vicinity of the nozzle 16. Although the adhesive is constantly moving away from the nozzle 16 and towards the substrate 20, it is believed that when the system is dispensing adhesive properly, the intersection of the adhesive fiber with a stationary horizontal plane located between the nozzle and the substrate, generally will move at approximately constant velocity in approximately a circular or elliptical path. As used herein, including the claims, "horizontal plane" is a plane which is perpendicular to the center line CL of the conical swirl pattern of the fiber under normal operating conditions.

A transmitter 30 and a receiver 32, are positioned outside of the envelope of the swirl and preferably in the vicinity of the nozzle opening. The positioning of the transmitter and receiver is not only important in the monitoring of the swirl, but is also important in minimizing the depositing of adhesive on them due to transient swirl conditions. If either does become coated with adhesive, they should be cleaned immediately. Large glue deposits can be cleaned with fresh adhesive and then with the use of alcohol. The transmitter 30 transmits a continuous beam of light, which preferably lies within a horizontal plane, which is in turn received by the receiver 32. It is preferred that the beam of light, transmitted from the transmitter to the receiver 32, lies within a horizontal plane.

It is important that the rotating fiber is capable of breaking or blocking the beam of light to the receiver as it passes through the beam of light. Therefore, the beam of light should be tightly focused, such as for example, as is produced by a laser. However, a tightly focused beam of light has been produced utilizing a light emitting diode (LED), as the light source, and in conjunction with a transmitter which includes a collimator and a focal point lens. While the beam of light may be collimated, it does not have to be. Generally, a tightly focused beam of light means that the diameter of the beam of light is about the same as the diameter of the fiber. Preferably, the diameter of the beam of light is smaller than the diameter of the fiber, so that the beam of light can be completely blocked as the fiber moves through the beam of light.

The transmitter 30 may be connected to a light source 34 by a fiber optic cable 36. The receiver does not necessarily require focussing lens. The receiver 32, may be for example, the open end of a fiber optic cable 32A, wherein the opened end 32 is in alignment with the transmitter for receiving the beam of light. Preferably, the diameter of the fiber optic cable used as the receiver 32 is about ½ the diameter of the smallest fiber diameter to be monitored. The output of the fiber optic cable may be connected through detection circuitry 38 to a computer 40. The computer 40 may have outputs connected to an alarm circuit 42 and through a control interface 44 to the system controls 46. The system controls 46 may have outputs connected to the dispenser 12 to control the dispensing of the fluid, to the air source 26 to control, for example, the pressure of the air delivered by the air jets 24 of the nozzle 16, to the adhesive source 28 to control, for example, the flow or pressure of the adhesive at the orifice of the nozzle 16, and to other control inputs of the system 10. The system controls 46 may also have outputs coupled to the computer 40 through the control interface 44.

In certain embodiments of the invention, closed looped feedback or programmed control, which is responsive to the monitored characteristics of the swirl pattern sensed by the transmitter/receiver 30,32, are compared by the computer 40 with stored desired characteristics of the sensed pattern characteristics, or is processed according to a programmed response function. Then, in response to the processing by the computer 40 of the signal from the receiver 32, control signals on the output lines from the system controls 46 control such parameters as the air pressure supplied by the source 26 at the jets 24, the pressure of the adhesive from the source 28, the on/off condition or other operating parameters of the dispenser 12, the speed of the conveyor 18, the temperature of the adhesive at various points of the system 10, or some other parameter or control of the system. Such feedback control may include additional sensors 48, which may monitor additional information from the system 10 and communicate the information, for example, to the system controls 46 through line 50 or to the computer 40 through line 52.

In one particular application, the transmitter and receiver were located in a horizontal plane located radially outwardly from the nozzle opening a distance A in the range of about ⅛" to about ¼" with a preferred distance of about 3/16". The transmitter and receiver were separated a distance B of about 1¼" with the receiver 32 spaced a distance C from the centerline of the swirl of about ½". The transmitter 30 included a collimator and a 25 millimeter focal point lens. The fiber optic cable 36 was a 200μ fiber optic cable while the fiber optic cable 32A of the receiver 32 was a 100μ fiber optic cable. The above configuration was used for a fiber 22 ranging in diameter from about 0.008 inches (0.203 mm) to about 0.045 inches (1.143 mm).

Figures 2A, 2B, 2C:
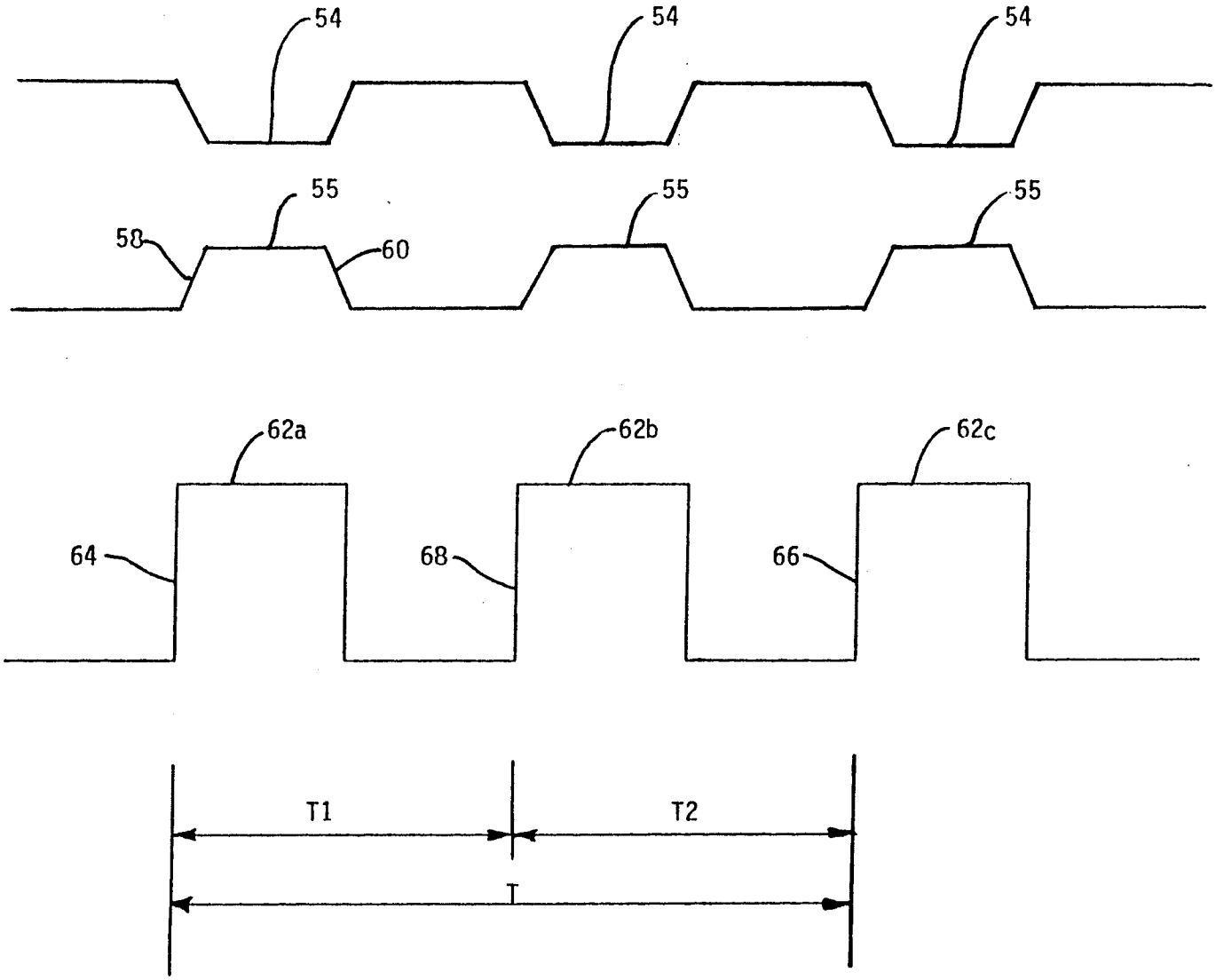
FIG. 2(*a*), (*b*) and (*c*) —Illustrates a series of signal waveform diagrams which illustrate portions of the operation of the embodiment of FIG. 1.
Figure 3:
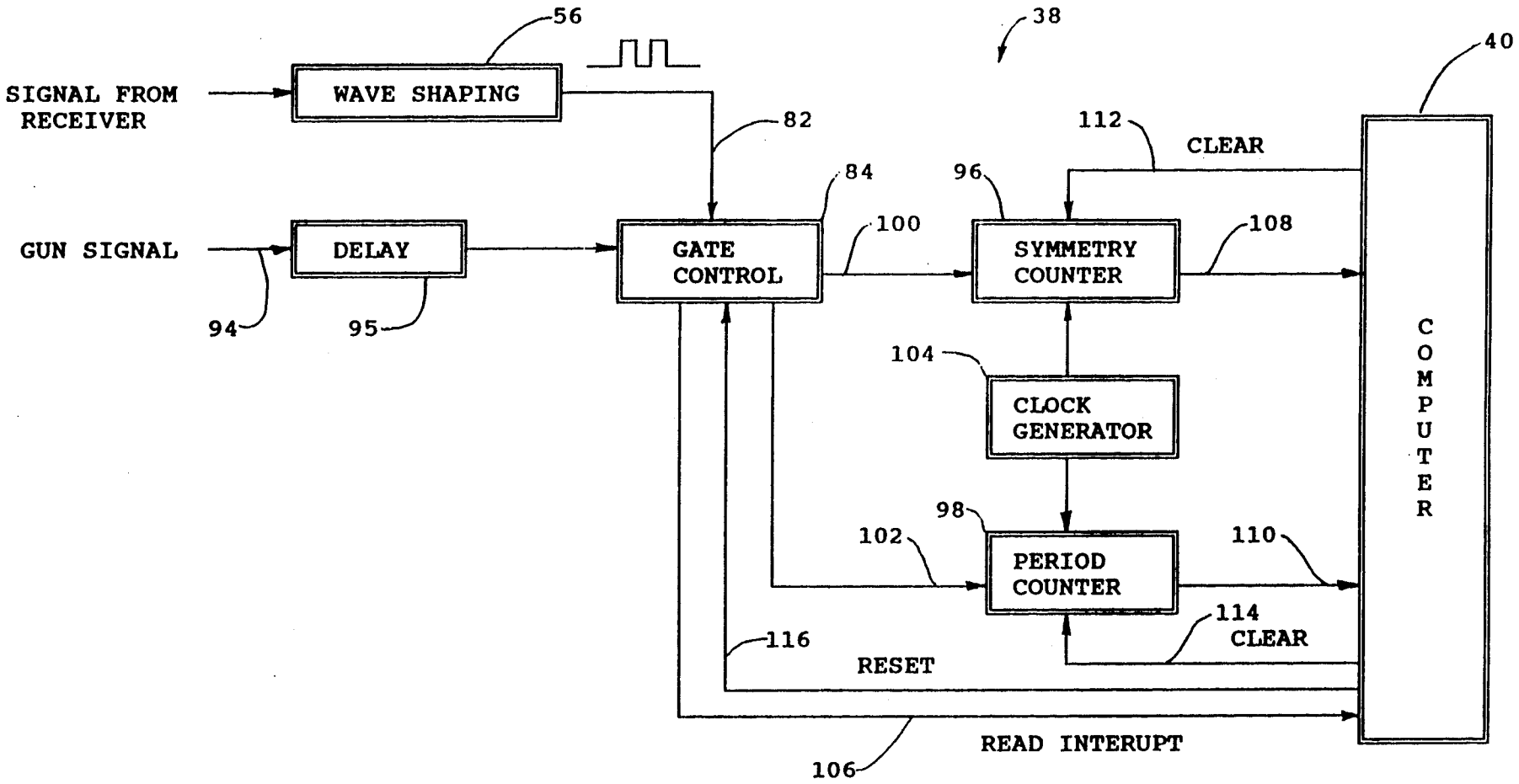
FIG. 3—Is a block diagram of the detection circuitry portion of the embodiment of FIG. 1.

With reference to FIGS. 2 and 3, the ideal output signal of the receiver 32 is shown at FIG. 2(A). As the adhesive fiber 22 rotates, it will break the beam of light received by the receiver 32 to produce an output signal of an undulating waveform that is received by a detection circuitry 38. Ideally, the undulating waveform will be trapezoidal, where the valleys 54 represent blockage of the light beam to the receiver 32. A corresponding electrical signal may be produced by the wave shaping circuitry 56 wherein the valleys 54 have been inverted to peaks 55, such as for example, as illustrated in FIG. 2(B). The wave shaping circuitry 56 may then be further shaped to produce a square wave beginning at each positive going edge 58 and ending at each negative going edge 60. Each pulse 62*a, b, c* of the square wave therefore illustrates a blockage of the light beam by the stream of adhesive 22.

In that the adhesive stream 22 is rotating in a generally circular path, the light beam will be broken twice for each revolution. Hence, two consecutive pulses 62*a,b* correspond to one complete rotation of the adhesive stream or fiber 22. Therefore, the period T of rotation of the swirl may be defined as the interval between a first rising edge 64 of a pulse 62*a* and the rising edge 66 of a second consecutive pulse 62*c*. The first half rotation of the swirl 22 can then be defined as the interval T1 from the rising edge 64 of the pulse 62*a* to the rising edge 68 of the next consecutive pulse 62*b*. The next half rotation T2 would be the interval from the rising edge 68 to the rising edge 66. The period T is then equal to T1 plus T2. If, under ideal conditions, the adhesive 22 is rotating symmetrically about the centerline CL, T1 will equal T2. Practically speaking, however, either T1 or T2 will be slightly larger than the other. However, by comparing the period and the half revolution intervals T1 and T2 to a reference, fluctuations or changes in the swirl pattern can be determined, as will be discussed in further detail below.

While the period has been indicated with respect to a using, or positive going edge of a pulse, which corresponds to the leading edge of the fiber as it enters the light beam, it could have been also indicated with respect to a falling, or negative going edge of the pulse, which corresponds to the trailing edge of the fiber as it exits the light beam. Therefore, the detection and signal processing to be described further below, could just as easily be employed to trigger on the falling edge of the pulse. As used herein, "leading edge" refers to a portion of the fiber which enters the beam of light first while "trailing edge" refers to a portion of the fiber which exits the beam of light last.

Figure 4:
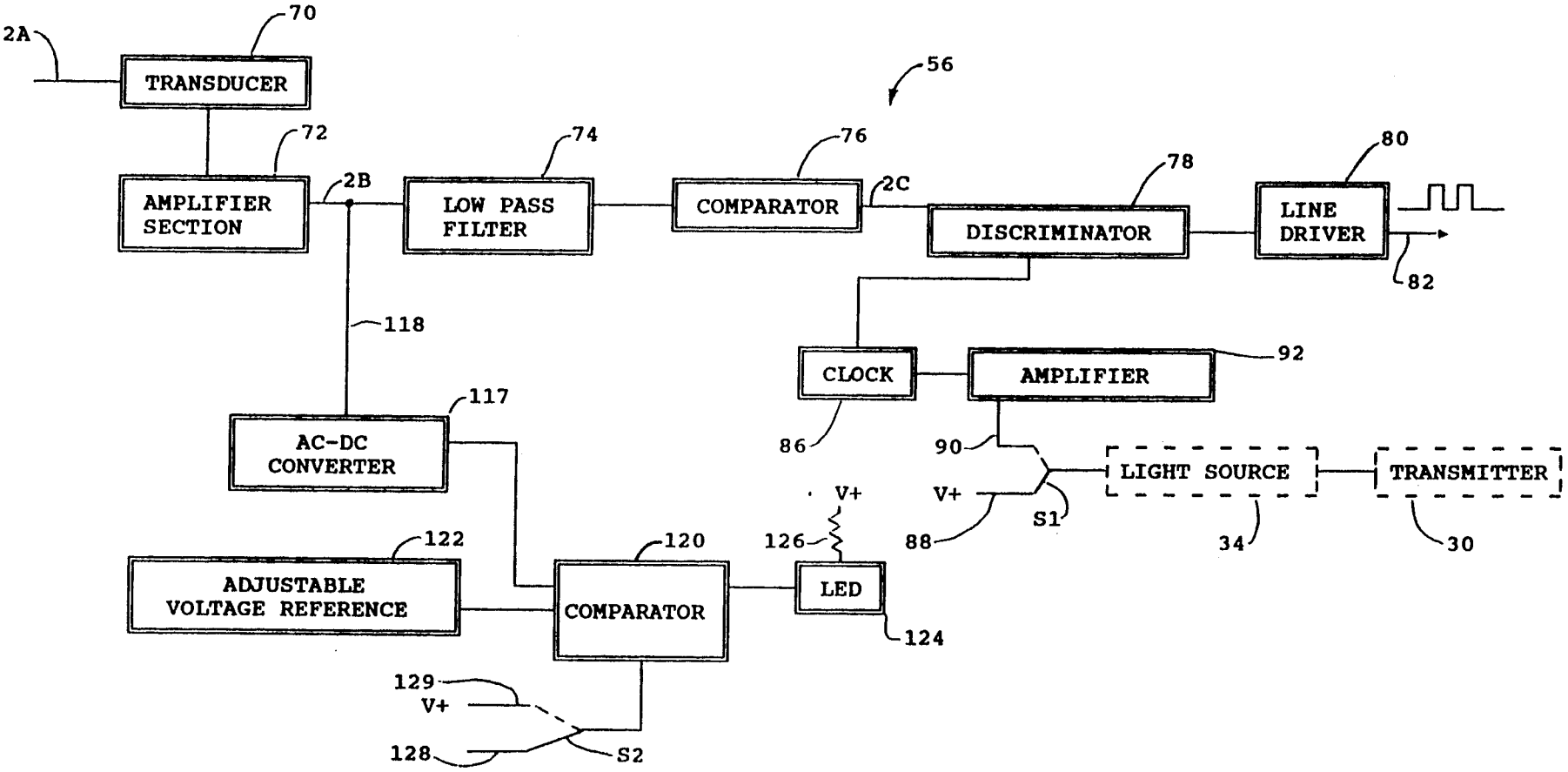
FIG. 4—Is a block diagram of the wave shaping portion of FIG. 3.

With reference to FIG. 4, the wave shaping circuitry is shown generally as reference numeral 56. A transducer 70, receives the output signal 2A, the undulating waveform of light, from the receiver 32 and generates an electrical output signal which is received by an amplifier section 72. The amplifier section 72 amplifies and inverts the signal to produce an electrical undulating waveform, such as for example, that shown in FIG. 2B. The amplifier 72 may comprise a three stage amplifier and inverter for amplifying the signal received from the light receiver 70. Each amplification stage of the amplifier 72 may be provided with DC blocking such that the DC component of the amplified signal is blocked or eliminated.

The output of the amplifier 72 is coupled to a low pass filter 74 which filters out high frequency noise which may have been generated during amplification or which may result from other spurious signals. In one particular application, the low pass filter had a cut-off frequency of about 3 kHz.

The output of the low pass filter 74 is coupled to a comparator 76. As the rising edge 58 of the electrical waveform 2B reaches a predetermined threshold, the output of the comparator 76 changes from a low or zero state to a high or 1 state and remains at a fixed level until a falling edge or negative going edge 60 of the waveform 2B falls below this threshold. At this point, the output of the comparator returns to the low or zero state. The comparator 76 therefore produces a series of pulses which result in a square wave, such as for example, as illustrated in FIG. 2C. The output of the comparator 76 is coupled to a discriminator 78 whose function is to filter out any spurious noise pulses from the square wave signal. This may be accomplished for example, by filtering out those pulses which do not have a duration longer than a certain time interval. For example, in one particular application, pulses having a duration less than 80μ seconds have been filtered out. The spurious pulses which the discriminator 78 filters out may result from a number of sources. Such as for example the jittering of the swirl, vibrations, and other high frequency noise sources. The discriminator 78 is coupled to a clock 86 for providing timing, while the output is coupled to a line driver 80. The output of the line driver is coupled via line 82 to the gate control 84 of FIG. 3.

Proper alignment of the transmitter and receiver is obviously very important. Therefore, it may be desirable to have a means for checking the alignment and the cable in the absence of the moving adhesive. This may be accomplished by the addition of a switch S1 which is connected to the light source 34, shown in phantom, and capable of switching between line 88, which is connected to a voltage source, and line 90, which is connected to an amplifier 92. In the normal or run mode, switch S1 would be positioned to connect to line 88 to provide a constant voltage source to the light source 34. In this position, the light source 34 produces a constant beam of light which is transmitted from the transmitter to the receiver.

In the alignment and cable check mode, the switch S1 would be transferred to line 90. In this position, the amplifier is driven by the clock 86 to produce an undulating waveform which drives the light source 34 to produce an undulating or pulsing beam of light which is in turn transmitted by the transmitter and received by the receiver. The output of the amplifier section 72 can then be compared to the output of the amplifier 92, such as through the use of an oscilloscope Adjustments in the alignment between the transmitter 30 and the receiver 32 can then be made until an acceptable waveform is observed at the output of the amplifier section. This method will also provide information as to the integrity of the fiber optic cables.

Alternatively, instead of using the oscilloscope to view the signal 2B to check the alignment of the transducer, an AC-DC converter 117 may be connected to the output of the amplifier section 72 via line 118. The AC-DC converter 97 rectifies the signal from the amplifier section 72 and is coupled to an input of a comparator 120. An equivalent rectified value of the scaled output amplitude of the AC waveform of amplifier 92 may be programmed into an adjustable voltage reference 122. The output of the adjustable voltage reference is then coupled to the other input of the comparator 120. The output of the comparator is coupled to an LED 124 which is coupled to a voltage source through a resistor 126. The comparator is enabled or disabled through a switch S2. In the alignment mode, the switch S2 is switched from position 128 to position 129 to enable the comparator 120. The output of the rectified signal from the AC-DC converter 117, in excess of the signal from the adjustable voltage reference 122, will cause the LED 124 to become activated. Therefore, when properly aligned, the LED 124 will become activated. Once aligned, the comparator 120 can be deactivated by moving switch S2 back to the off position 128.

With reference to FIG. 3, a gun signal is received via line 94 to indicate the actuation of the gun 14. The gun signal 94 is coupled to the gate control 84 via delay circuitry 95, which for a predetermined time delays the gun signal to the gate control 84. This delay allows for the adhesive to begin dispensing from the gun, to form a swirl, and to reach a substantial steady state condition before the swirl characteristics are analyzed. This delay is necessary in order to avoid sampling transient swirls, which may be formed upon actuation of the gun. The delay period should be set such that sampling can begin once the time interval for encountering transient swirls has past. If the delay period is too short, the system will begin sampling swirls which are not completely formed. This can cause an inadvertent error signal or otherwise affect the accuracy of the sampled data. A delay period which is too long may, in fact, miss bad swirls, or it may miss sampling any swirls if the gun-on times are short durations. In one embodiment, the delay period was capable of being adjusted from 5.6 mS to 105 mS, and in at least one particular application was set for 40 mS.

The gate control 84 is coupled to a symmetry counter 96 and a period counter 98 via lines 100 and 102 respectively. The symmetry counter 96 is used for determining the half revolution interval T1. The period counter 98 is used for determining the interval of the period T (i.e. the length or duration for one rotation of the swirl).

Upon receipt of the signal from the delay counter 95 and a rising edge 64 of a pulse **62*a* of the signal received from the wave shaping circuitry 56, a signal is sent to both the symmetry and the period counters via lines 100 and 102 respectively. The symmetry counter 96 and period counter 98 both begin counting clock pulses received from a clock generator 104. Upon receipt of the next rising or positive going pulse edge 68, the gate control sign via line 100 will be disabled causing the symmetry counter 96 to stop counting while keeping the accumulated count within its register. The period counter, on the other hand, will continue to count until the second consecutive rising or positive going edge 66 is received by the gate control 84. The gate control will then disable the output via line 102 to the period counter 98 thereby stopping the counter and keeping the accumulated count within its register. The gate control then sends a read interrupt signal via line 106 to the computer 40. Upon receipt of the read interrupt signal, the computer 40 reads the count total in the symmetry counter 96 and the period counter 98 via lines 108 and 110 respectively. After the count from the symmetry and period counters has been stored within the appropriate registers of the computer 40, a signal is sent from the computer via lines 112 and 114 to clear the symmetry 96 and period 98 counters. The computer also sends a signal to the gate control via line 116 to reset the gate control. The gate control then will repeat the above procedure upon the receipt of the next positive going edge of a pulse 62 provided that a signal is still being received from the delay counter 95**, including the continued presence of the gun signal.

The gate control may include, for example, a shift register. One such shift register that has been used is a 74HC164, as manufactured by Motorola.

With reference to FIG. 2, the output of the period counter 98 will correspond to the period T of the rotation of the swirl which, in turn, is equal to the time interval of two consecutive pulses **62*a*, 62*b***. By comparing the period of the rotation of the swirl to a reference, changes in the swirl can be noted. For example, if the time interval of the period T begins to increase, this would indicate that either the angular velocity of the swirl was decreasing or that the diameter of the envelope of the swirl was increasing, or a combination of both. In like manner, while comparing T1 to a reference, it can be determined if the centerline of the swirl has shifted from its intended orientation.

In that the swirl is rotating at a fairly fast, angular velocity, and that some transient deviations may exist in this rotation, it is preferred that a number of samples of the period are gathered and the average or mean of these samples is determined. The error checking portion then compares a running averaging value of the mean against reference. When this reference is exceeded, an error condition is noted.

The degree of deviation among the mean of the sampled data will depend on the number of samples taken. The smaller the number of samples, the larger the deviation will be, while the larger the number of samples, the smaller the deviation will be. Therefore, collecting many samples will yield smaller deviations. However, the trade-off is that the more samples collected, increases the time necessary to determine the average, which may result in a slower response time to error. It has been found in at least one embodiment or application that taking the average of 256 samples provides good results.

Figure 5:
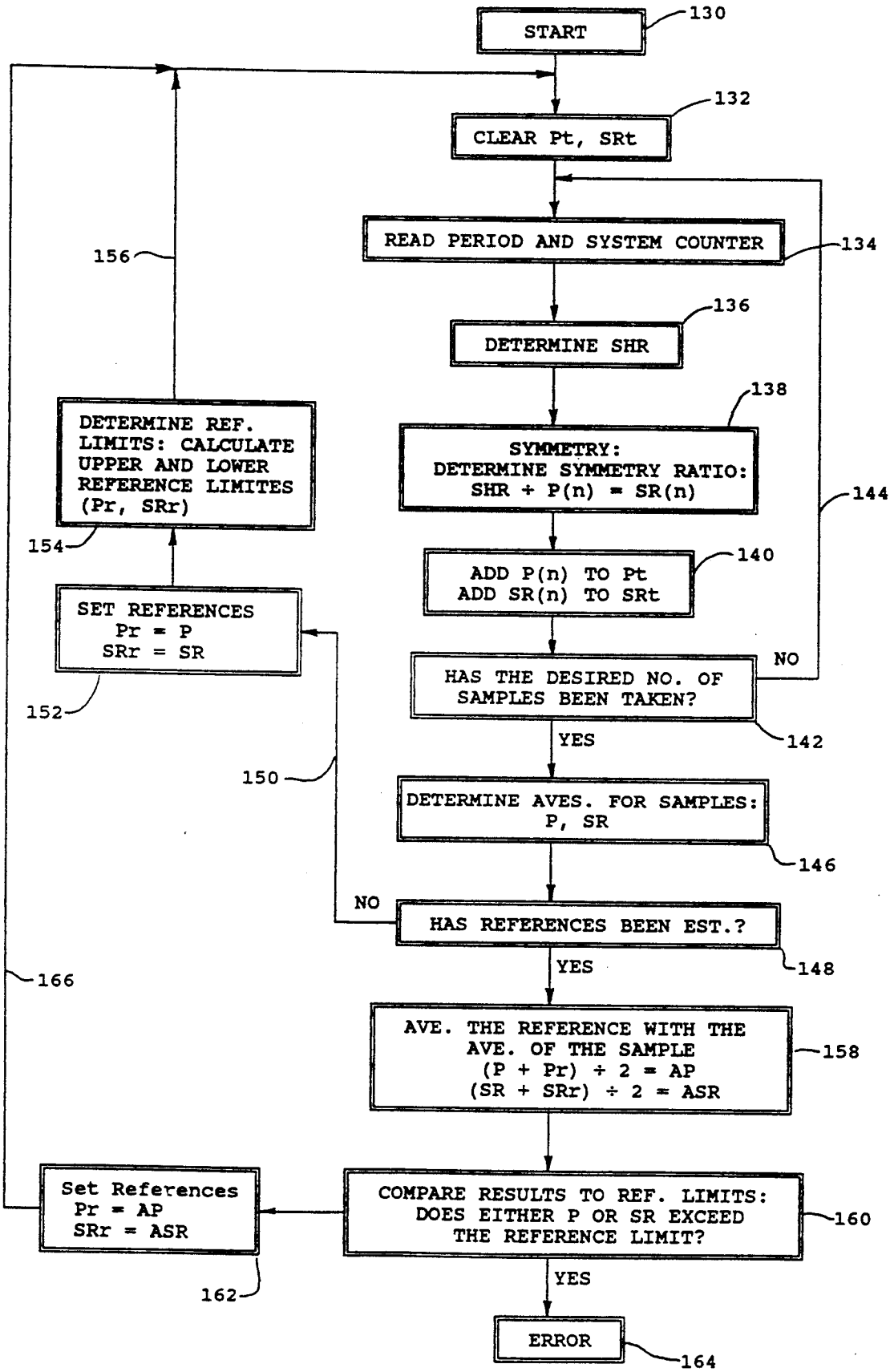
FIG. 5—Is a flow chart of a portion of the process control.

Now, with reference to FIG. 5, there is illustrated a flow diagram that may be used in conjunction with the computer 40 in order to process the signals received from the symmetry 96 and period 98 counters. The computer program is entered at the start at point 130. The registers Pt and SRt are first cleared to eliminate or remove any previous or spurious data stored within them. The register Pt is the register that holds the summation of all the counts received from the period counter 98 taken during a sampling period. Likewise, the register SRt is the register that holds the summation of all the counts received from the symmetry counter 96 taken during the same sampling period. The computer 40 then reads the data that has been accumulated in the period counter 98 and the symmetry counter 96 at block 134 from one sample.

As mentioned previously, the half revolution intervals T1 and T2 may not always be equal to one another. For a given swirl that is operating properly however, this relationship should remain fairly constant. For example, if T1 is smaller than T2, this relationship should stay constant unless there is a change in the swirl pattern. However, if the sampling period were to begin at the first rising edge 68 of the square wave **62*b* of FIG. 2 instead of the rising edge 64 of the 62*a*, the result would be that T2, which would now be the first interval, would be greater than the second interval, which would now be T1. In other words, the relationship would be off by one-half of a revolution. Therefore, at block 136 the smallest one-half revolution SHR is determined. This may be accomplished by the following: $X=P(n)-S(n)$; and SHR is equal to the smaller of either X or S(n); where SHR is the smallest half revolution, P(n) is the count received from the period counter 98, and S(n) is the count received from the symmetry counter 96**. In other words, SHR is equal to the smaller of the intervals T1 or T2. Therefore, this provides a method of determining whether the data received from the symmetry counter corresponds to T1 or T2.

Once the smallest half revolution SHR has been determined, the symmetry ratio SR(n) may be determined at block 138. This is accomplished by dividing the smallest half revolution SHR by the period of the sample P(n). At block 140, the period of the sample P(n), the value received from the period counter 98, is added to the register containing the total of period counts for this sample, Pt. In like manner, the symmetry ratio SR(n) of the sample is added to the totalizing register of the symmetry SRt at block 140.

If the desired numbers of samples from the symmetry and period counters has not been received, such as 256 samples, 512 samples, etc., the above is repeated via line 144 until the desired number of samples has been taken and totalized. When the desired number of samples has been reached, for example, 256, the register Pt would include the summation of the previous 256 readings of the period counter 98. In like manner, the symmetry register SRt would include the summation of the previous 256 calculations of the symmetry ratio SR(n). Once the desired number of samples has been reached for a sampling period, the average period P and the average symmetry ratio SR is found by dividing Pt and SRt each by the number of samples taken, such as in this case, 256 at block 146.

If no previous references have been established, such as may be experienced during start-up, the reference limits must be established. Hence, at block 148, if no reference limits have been previously established, then via line 150, the period reference PR is set equal to the average calculated period P while the symmetry reference SRr is set equal to the calculated average symmetry SR at block 152. Once the period and symmetry references have been established, the deviations from these references may be determined at block 154. For example, if the period reference Pr is equal to 1,000 counts, it may be determined that swirls having an average period of between 900 and 1,100 (plus or minus 5%) would be acceptable. After these limits or ranges have been established then the above procedure is repeated by beginning with the clearing of the Pt and SRt registers at block 132 via line 156.

If however, at block 148, the reference limits had already been established, then the average of the period is averaged with the period reference to produce an average of the means of the period AP at block 158. Similarly, the average of the symmetry ratio is averaged with the symmetry ratio reference to produce an average of the mean of the symmetry ratio ASR. The results of the calculation of block 158 are then compared to the previously established reference limits, at block 160. If both AP and ASR, the average of the means for the period and symmetry, are within their respective reference limits (upper and lower), then the period and symmetry references are changed to equal the average of the means AP and ASR respectively at block 162. If, however, either AP or ASR is outside of the respective reference limits, an error signal is generated at block 164. After this has been accomplished, the procedure is repeated via line 166.

For example, if the period of the reference is 1000, while the upper and lower references are 1100 and 900 respectively, then if the average of the period P for the next sampling interval is found to be 1012, the average of the means AP would be 1006 $[(1000+1012)\div 2]$. This falls within the range of between 900 and 1100, and assuming that the average of the means of the symmetry ASR also is within its range, then there is no error. The period reference Pr would then be set equal to 1006. On the next pass, if the average of the period P is found to be 1054, then the average of the means AP becomes 1030 $[(1006+1054)\div 2]$, which is also within the range of 900–1100 counts. Therefore, there would be no error in regard to the period and the period reference Pr would then be set equal to 1030.

If the average of the period P for the next sampling period is found to be 1160, then the average of the means AP would be 1085 which is still within the period range and no error would be indicated. Therefore, even though the average of the period P was clearly outside of the upper limit, no error would be indicated.

While an alarm or error could have been indicated because the average of the period P exceeded the upper reference limit, it is believed that the above is more preferred because it provides a means to help reduce nuisance errors. In other words, it is possible that the average of the period P could exceed the reference limit due to some occurrence which is not necessarily a result of a problem with the swirl or there could have been a transient problem with the swirl and the problem has been self corrected. Therefore, this method generally allows the reference limit to be exceeded for a couple of sampling periods in order to ensure that a genuine error condition exists. It should be noted under some circumstances, such as if the average of the period P is much greater than the period references, that the system may very well indicate an error condition the first time the reference limit is exceeded because the average of the means AP may be outside the reference limit. For example, if Pr=1050 and P=1200, AP would then equal 1125 which would cause an error to be indicated. Therefore, the above method provides a means for reducing the sensitivity of the error detection.

With reference to determining the reference limits of block 154, in one application these limits were set at plus or minus 15% for the period and plus or minus 20% for the symmetry. It should be kept in mind that these limits are chosen such that for a given set of conditions, the running average of the period and symmetry will not exceed these limits unless an error occurs. For a particular application, the error limits may be chosen or set automatically from a look-up table that has been generated from actual data associated with this type of installation or similar ones. This look-up table, for example, may be generated by monitoring the period of the swirl at various different air pressures. An average period can then be determined for this given air pressure. This average period may then be compared with a number of other average periods to determine the average of all the other averages. Then, the lowest and highest average of these samples can be used to establish the upper and lower reference limits.

Utilizing the upper and lower reference limits, the percent deviation of the total average can be determined. The greatest deviation of these can then be used if desired as the overall system deviation. In this manner, since the error limit chosen represents the worst case statistical range among the means for a given air pressure, it follows then that under normal operation the running average of the sample means should not be exceeded This can be repeated for different nozzles and for different ranges of fluid operating pressures. Similarly, the above can be repeated for the symmetry error limits.

This invention provides for a closed loop feedback control for verifying changes in the operation of the swirl. For example, if the adhesive dispensing system provides for an increase or a decrease in the operating pressure of the fluid, there should be a corresponding change in the period and/or symmetry of the swirl. By monitoring the change in the swirl period or symmetry and comparing this to a reference at a given pressure, the change in the swirl characteristics can be verified. Similarly if the air pressure to the jets was changed, this system would provide a means for verification of such change.

Changes in the swirl may be required due to changes in the line speed of the substrate, such as in gear to line installations. For example, a signal received indicating that the line speed of the substrate has increased/decreased may require an increase/decrease in the period of the swirl in order to maintain the same deposition coverage. Changes in the pattern may also be required if the type of adhesive is changed or if the substrate to be coated changes.

This invention may also provide for a method of automatic correction of the moving pattern. In the above embodiments, the moving pattern was a swirl and that an error or alarm condition would be indicated if the rotation of the fiber produced either a period or symmetry ratio that was outside the respective reference limits. However, while a moving fiber of material that produces a period or symmetry ratio within the respective period and symmetry limits corresponds to an acceptable pattern it does not necessarily correspond to an optimum pattern. Therefore, this invention may also provide for the monitoring of the pattern and controlling the dispensing system to correct for changes in the pattern in order to maintain an optimum pattern. One benefit of this is that the amount of adhesive deposited and/or its placement may be optimized.

Using the example that the lower and upper references for the period are 900 and 1100 respectively, it may be found that a more preferred pattern results when the period is between 950 and 1050. Therefore, if after determining that an error condition does not exist because the average of the period AP and the average of the symmetry ratio are both within their acceptable limits, the average of the period AP could be compared to a preferred set of reference limits instead of returning via line 166 to the beginning of the block diagram.

If the period exceeds the preferred reference limit, but does not exceed the error reference limits, then a signal can be generated to adjust or change the period of the pattern. For example, if the average of the period AP is found to be 1075, this would indicate that the fiber is not rotating or swirling fast enough for an optimum pattern, but does not indicate an error condition. The computer may then send a signal via the control interface 44 and the system controls 46 of FIG. 1 to cause the air source 26 to increase the air pressure of the air emitting from the air jets 24. This in turn would cause the swirl to rotate faster. Alternatively, the computer 40 could send a signal to the adhesive source 28 to change the rate of pressure at which the material is being dispensed. Less material dispensed will be more easily swirled, which will then decrease the period. Another alternative would be to change both the amount of material dispensed and the force (such as the air pressure) used to cause the fiber to rotate. The procedure would then be repeated by returning via line 166 to the beginning of the block diagram of FIG. 5.

If on the other hand, the period is shorter than desired, indicating that the pattern is moving too fast, then the amount of material dispensed and/or the amount of force causing the fiber to move in the pattern can be reduced.

One embodiment of this invention may also provide information relating to changes or wear in the nozzle and/or air jets. For example, over time, the period or symmetry may begin to change from one base line of operation to another. This may be due to wear of the nozzle and/or the air jets. Alternatively, in the automatic compensation embodiment, it is believed that the wear of the nozzle and/or air jets may be also indicated by the changes required to keep the period within the preferred limits.

While certain representative embodiments and details have been shown for the purpose of illustrating the invention, it will be apparent to those skilled in the art that various changes and modifications may be made therein without departing from the scope of the invention.

It is claimed:

1. A method of monitoring a fiber of material comprising:

a) transmitting a beam of light;

b) causing the fiber to repeatedly pass through the beam of light;

c) generating a signal in response to the presence or absence of the fiber within the beam of light;

d) determining an interval between the presence of the fiber in the beam of light and a subsequent presence of the fiber in the beam of light; and e) comparing the interval to a reference.

2. The method of claim 1 wherein the interval of step d) is the interval between two consecutive breakages of the beam of light by the fiber.

3. The method of claim 2 wherein the breakage of the beam of light includes generating an edge signal when an edge of the fiber bears a relationship to the beam of light.

4. The method of claim 2, further comprising determining an interval between a breakage of the beam of light and a third consecutive breakage of the beam of light by the fiber; and comparing the interval between the breakage of the beam of light and the third consecutive breakage of the beam of light to a reference.

5. The method of claim 4 wherein the breakage of the beam of light includes generating an edge signal when the edge of the fiber bears a relationship to the beam of light.

6. The method of claim 1 wherein the interval of step d) is the interval between a breakage of the beam of light and a third consecutive breakage of the beam of light by the fiber.

7. The method of claim 1 wherein step d) includes generating an edge signal in response to the generated signal of step c) when the edge of the fiber bears a relationship to the beam, and determining the interval between edge signals.

8. A method of monitoring or controlling a fiber moving generally from a discharge opening to a substrate in a repeating pattern, comprising the steps of:

a) determining a period of the pattern;

b) determining a symmetry of the pattern;

c) comparing the period and the symmetry of the pattern to a respective reference;

d) in response to said comparison, performing at least one of the following steps:

i) changing the rate at which the fiber is dispensed from the discharged opening, ii) varying the period of the pattern, iii) indicating the status of the pattern, and iv) repeating steps a) through d).

9. A method of dispensing a fiber of material comprising the steps of:

dispensing the fiber of material from a discharge opening of a dispensing means;

causing the dispensed fiber of material to propagate in a moving pattern through a space between the discharge opening and a substrate;

transmitting a beam of light such that, under normal operating conditions, the fiber of material will pass through the beam of light at least twice as it propagates in the moving pattern;

detecting said beam of light and generating in response to the absence or presence of said beam of light a signal;

generating an edge signal in response to said signal when an edge of the fiber of material bears a relationship to the beam of light;

generating a symmetry signal indicative of, or proportional to, either a time interval between a first said edge signal and a second edge signal or a time interval between the second said edge signal and a third edge signal;

generating a period signal indicative of, of proportional to, the time interval between said first edge signal and said third edge signal; and determining the status of the motion of the pattern in response to said period and symmetry signals.

10. The method of claim 9 further comprising the step of controlling the dispensing means in response to changes in the status of the motion of the pattern.

11. The method of claim 9 further comprising the step of indicating an alarm in response to the status of the pattern being in excess of a reference.

12. The method of claim 9 wherein said step of determining the status of the motion of the pattern includes determining an average period for a plurality of period signals and comparing the average period to a reference and indicating the status of the pattern in response to said comparison.

13. The method of claim 12 wherein said step of determining the status of the motion of the pattern includes:

determining an average symmetry for a plurality of symmetry signals; determining an average symmetry ratio wherein the symmetry ratio is the ratio of the average symmetry divided by the average period; and comparing the average symmetry ratio to a reference and indicating the status of the motion of the pattern in response to said comparison.

14. The method of claim 9 further comprising the steps of:

controlling or adjusting the dispensing means in response to an external control signal for performing at least one of the following:

a) varying the discharge of the fiber of material from the discharge opening of the dispensing means, and b) varying the pattern of the fiber.

15. A method comprising the steps of:

a) dispensing a bead of adhesive from a discharge opening of a dispensing means at a flow rate;

b) causing the dispensed bead of adhesive to propagate in a rotating pattern through a space between the discharge opening and a substrate;

c) transmitting a beam of light such that, under normal operating conditions, the bead of adhesive will pass through the beam of light at least twice as it moves in said pattern;

d) detecting said beam of light and generating in response to the presence or absence of said beam of light a signal;

e) comparing said signal to a reference; and in response to said comparison performing at least one of the following steps:

i) varying the rate at which the bead of material is dispensed from the discharged opening;

ii) varying the rate at which the bead of material rotates in said pattern, and iii) indicating the status of the pattern.

16. The method of claim 15 wherein said comparison comprises: comparing an interval between the presence of the bead in the beam of light to a subsequent presence of the bead in the beam of light.

17. The method of claim 15 wherein said comparing step comprises the steps of determining a period of the pattern; determining symmetry of the pattern; and comparing the period and the symmetry of the pattern to a respective reference.

18. The method of claim 15 wherein said comparing step comprises the steps of:

generating an edge signal in response to said signal when an edge of the bead of material bears a relationship to the beam of light;

generating a symmetry signal indicative of, or proportional to, either a time interval between a first said edge signal and a second edge signal or a time interval between the second said edge signal and a third edge signal;

generating a period signal indicative of, or proportional to, the time interval between said first edge signal and said third edge signal; and determining the status of the motion of the pattern in response to said period and symmetry signals.

19. The method of claim 18 wherein said step of determining the status of the motion of the pattern includes determining an average period for a plurality of period signals and comparing the status of the pattern in response to said comparison.

20. The method of claim 19 wherein said step of determining the status of the motion of the pattern includes;

determining an average symmetry for a plurality of symmetry signals; determining an average symmetry ratio wherein the symmetry ratio is the ratio of the average symmetry divided by the average period; and comparing the average symmetry ratio to a reference and indicating the status of the motion of the pattern in response to said comparison.

* * * * *

UNITED STATES PATENT AND TRADEMARK OFFICE

CERTIFICATE OF CORRECTION

PATENT NO. : 5,208,064

DATED : May 4, 1993

INVENTOR(S) : Kevin C. Becker, et al

It is certified that error appears in the above-indentified patent and that said Letters Patent is hereby corrected as shown below:

Column 7, line 11, a --.-- should be inserted between "oscilloscope" and "Adjustments".

Column 11, line 32, a --.-- should be inserted between "exceeded" and "This".

Column 13, line 64, "of, of" should be --of, or--

Signed and Sealed this

Seventh Day of June, 1994

Bruce Lehman

*Attest:*

BRUCE LEHMAN

*Attesting Officer*

*Commissioner of Patents and Trademarks*